United States Patent [19]

Green et al.

[11] Patent Number: 4,519,326

[45] Date of Patent: May 28, 1985

[54] SEGMENTAL NEEDLE BAR FOR MULTIPLE NEEDLE TUFTING MACHINE

[75] Inventors: Jerry T. Green, Hixson; Max M. Beasley, Chattanooga, both of Tenn.

[73] Assignee: Tuftco Corporation, Chattanooga, Tenn.

[21] Appl. No.: 639,804

[22] Filed: Aug. 13, 1984

Related U.S. Application Data

[62] Division of Ser. No. 464,410, Feb. 7, 1983, Pat. No. 4,483,261.

[51] Int. Cl.[3] ..... D05C 15/00

[52] U.S. Cl. ..... 112/79 R

[58] Field of Search ..... 112/79 A, 79 R

[56] References Cited

U.S. PATENT DOCUMENTS 3,396,687 8/1968 Nowicki ..... 112/79 A
4,138,956 2/1979 Parsons ..... 112/79 R
4,366,761 1/1983 Card ..... 112/79 R
4,398,479 8/1983 Czelusniak ..... 112/79 R

*Primary Examiner*—Ronald Feldbaum
*Attorney, Agent, or Firm*—Harrington A. Lackey

[57] ABSTRACT

A needle bar assembly for a multiple needle tufting machine including an elongated continuous mounting bar connected to the push rod of the needle drive mechanism for reciprocal movement, and a plurality of elongated, but substantially shorter, needle bar segments having needle holes for receiving the needles and secured end-to-end along and to the mounting bar, whereby individual needle bar segments may be independently attached and detached to the mounting bar, and longitudinally adjusted if desired. The needle bar assembly also contemplates a pair of needle mounting bars slideably received in a needle bar holder connected to the needle drive mechanism and two sets of substantially shorter needle bar segments secured end-to-end along each of the corresponding needle mounting bars.

5 Claims, 9 Drawing Figures

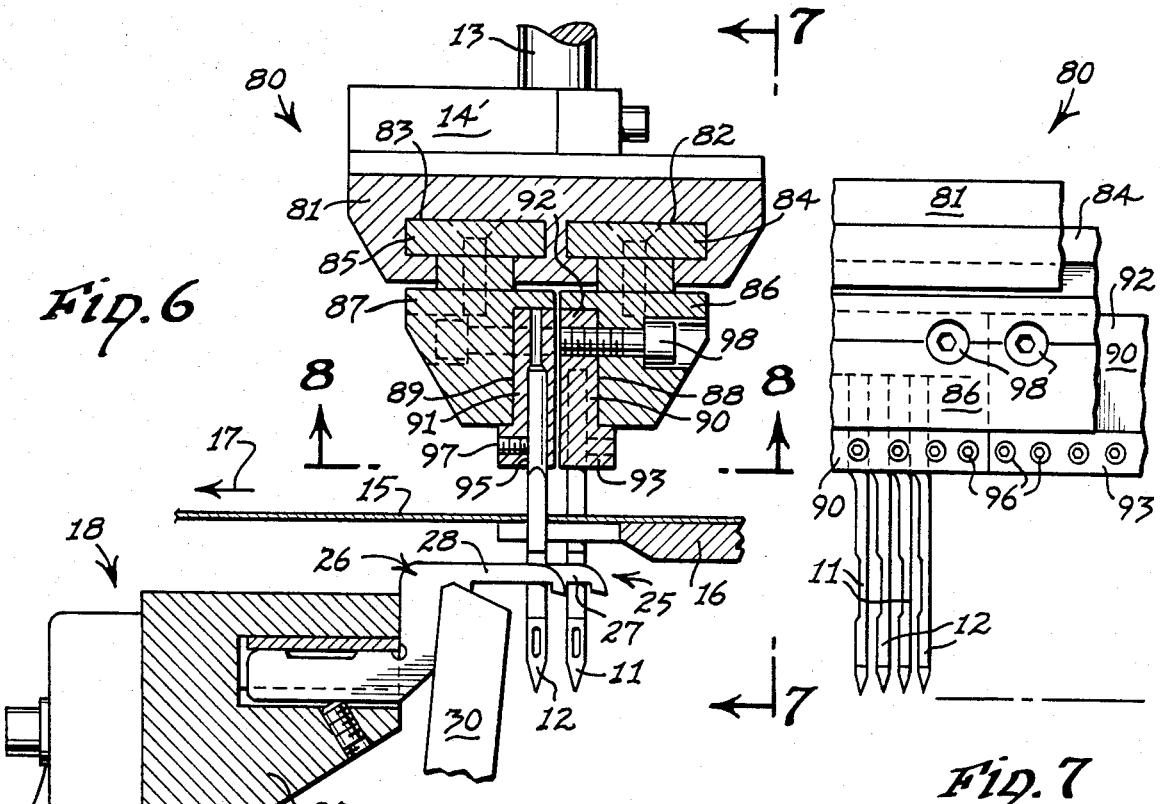
Fig. 6
Fig. 7
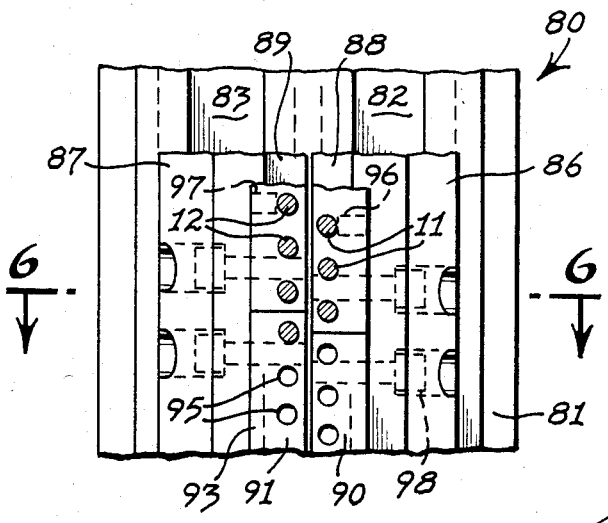
Fig. 8
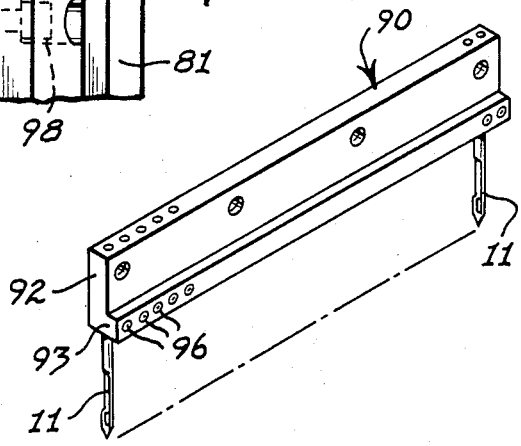
Fig. 9

SEGMENTAL NEEDLE BAR FOR MULTIPLE NEEDLE TUFTING MACHINE

CROSS-REFERENCE TO RELATED APPLICATION

This is a division of application Ser. No. 464,410, filed Feb. 7, 1983 now U.S. Pat. No. 4,483,261.

BACKGROUND OF INVENTION

This invention relates to a multiple needle tufting machine, and more particularly to a needle bar assembly for a multiple needle tufting machine.

The conventional needle bars for multiple needle tufting machines are long, continuous, solid bars extending transversely of the machine above the base fabric for the entire width of the fabric to be tufted. A conventional needle bar includes a plurality of needle holes extending vertically through the needle bar and desirably parallel to each other, uniformly spaced at the desired needle gauge. Each needle is inserted through the needle hole in the bottom of the needle bar so that each needle extends substantially the full height, if not the full height, of the needle bar. The needles are secured in position in their respective needle holes by transverse set screws.

The conventional needle bar has always been one of the most difficult parts of a tufting machine to manufacture, since the numerous needle holes must be drilled very accurately in the long needle bar. It is extremely difficult to control the path of the drill bit through a needle bar which is usually $\frac{7}{8}''$ in depth or height. In the drilling operation, the drill bit often "leads off" in one direction or another at an angle to the vertical. Accordingly, such angular drill holes through the needle bar will not be parallel to each other. Therefore, the elongated needles extending through the angular needle holes would be "off gauge" where the needle holes are not drilled in truly vertical paths. The longer the needle, therefore, the greater the gauge error.

The "leadoff" of the drilling paths for each needle hole may be caused by various factors. A drill bit which is not accurately ground, or a drill bit being forced too rapidly into the metal of the needle bar, or a drill bit striking the more dense or harder portion of the metal in the needle bar, can cause the drill bit to deflect from its truly vertical course. Once the "leadoff" begins, the continuing path of the drill bit will diverge further away from the desired vertical course.

Once the drilling of the conventional needle bar has commenced, it is not possible to determine the path of the drill bit unitl it emerges from the opposite side of the needle bar. In a multiple needle tufting machine having several hundred needles, the gauge errors between the needles caused by the inaccurate drilling of the needle holes can create considerable problems.

Not only does the drilling of the needle holes involve maintaining accurate control of the drilling paths of the drill bits, but occasionally a drill bit will break off in the drilled needle hole, and the broken drill bit cannot be removed without damaging the needle bar.

All of the above problems in the drilling of the needle holes can result in a needle bar which cannot be used and which must be discarded or scrapped.

Normally, it takes approximately 40 man-hours to drill all of the required needle holes in a conventional needle bar of a multiple needle tufting machine.

SUMMARY OF THE INVENTION

It is therefore an object of this invention to provide in a needle tufting machine an improved needle bar assembly incorporating multiple, modular, needle bar parts that will provide a more accurate needle gauge.

The needle bar assembly made in accordance with this invention, includes a long, continuous, mounting bar which is attached directly to the conventional push rods of the needle drive mechanism of the tufting machine, the mounting bar extending the full width of the fabric to be tufted, or in other words, the same length as the conventional needle bar. The plurality of short needle bar segments in the order of 6–12″ in length are designed to be secured by appropriate fastener mechanisms such as bolts, in an end-to-end relationship along, beneath, and to the mounting bar. In each of the needle bar segments, is drilled a plurality of holes at the desired needle gauge. These holes may be in a single straight line, or they may be alternately staggered in a well known manner. The length of the needle bar segments are so limited that the needle gauge will be maintained throughout the length of the needle bar assembly when the needle bar segments are fastened end-to-end beneath the mounting bar.

Because of the combined structure of the mounting bar and the needle bar segments, the height or depth of the needle bar segments, in the order of $\frac{1}{2}''$, is less than the height or depth of a conventional needle bar. Preferably, the needle bar segments are spaced below the bottom surface of the main portion of the mounting bar so that the needles received within their corresponding needle holes will project above the needle bar segments and engage the bottom or abutment surface of the mounting bar. Because of the lesser depth of the needle bar segments than conventional needle bars, any drilling "leadoffs" or divergences from the true vertical course of the drill bit will be minor. Moreover, because of the relatively short lengths of the needle bar segments, the needle holes may be drilled on an ordinary milling machine on which more accurate spacing can be achieved by moving the short needle bar segment within the travel limits of the milling machine table.

Because of the modular construction of the needle bar assembly made in accordance with this invention, small spacing may be provided between the ends of the needle bar segments in order to permit small lateral adjustments to compensate for any gauge errors and permit the needles to accurately align with the tufting hooks below the fabric.

Moreover, if there are any substantial drilling errors in the needle bar segemnts, then only that needle bar segment which includes the unacceptable drilling error can be discarded without sacrificing the remaining needle bar segments.

Furthermore, because of the modular arrangement of the needle bar segments, an entire set of needle bar segments may be replaced by another set of needle bar segments having a different needle gauge, without removing the continuous mounting bar from the push rods.

The mounting bar and the needle bar segments made in accordance with this invention may include overlapping tongue-and-groove structures secured together by detachable bolt-type fasteners in order to assemble and disassemble the various needle bar segments upon the mounting bar. In one form of the invention, the mounting bar may have an inverted U-shaped cross-section to define a pair of depending legs receivable within corresponding longitudinal recesses formed in the upper surfaces of the corresponding needle bar segments. In another form of the invention, the needle bar segments may have U-shaped transverse cross-sections with the legs projecting upward and receivable in longitudinally extending grooves or recesses formed in the bottom surface of the monolithic or solid elongated continuous mounting bar.

The needle bar assembly made in accordance with this invention can also be adapted for use in dual shiftable needle bars, such as those illustrated in U.S. Pat. No. 4,366,761. In such an arrangement, the dual needle mounting bars may be provided with recesses into which extend the upward projecting portions of corresponding sets of substantially shorter needle bar segments, and secured in place by detachable bolt-type fasteners.

BRIEF DESCRIPTION OF THE DRAWINGS

FIG. 6 is a sectional elevation of a modified needle bar assembly for a dual shiftable needle bar type tufting machine, taken along the line 6—6 of FIG. 8;

FIG. 7 is a fragmentary front elevation taken along the line 7—7 of FIG. 6;

FIG. 8 is a fragmentary section taken along the line 8—8 of FIG. 6; and FIG. 9 is a front perspective view of one of the front needle bar segments.

DESCRIPTION OF PREFERRED EMBODIMENTS

Figure 1:
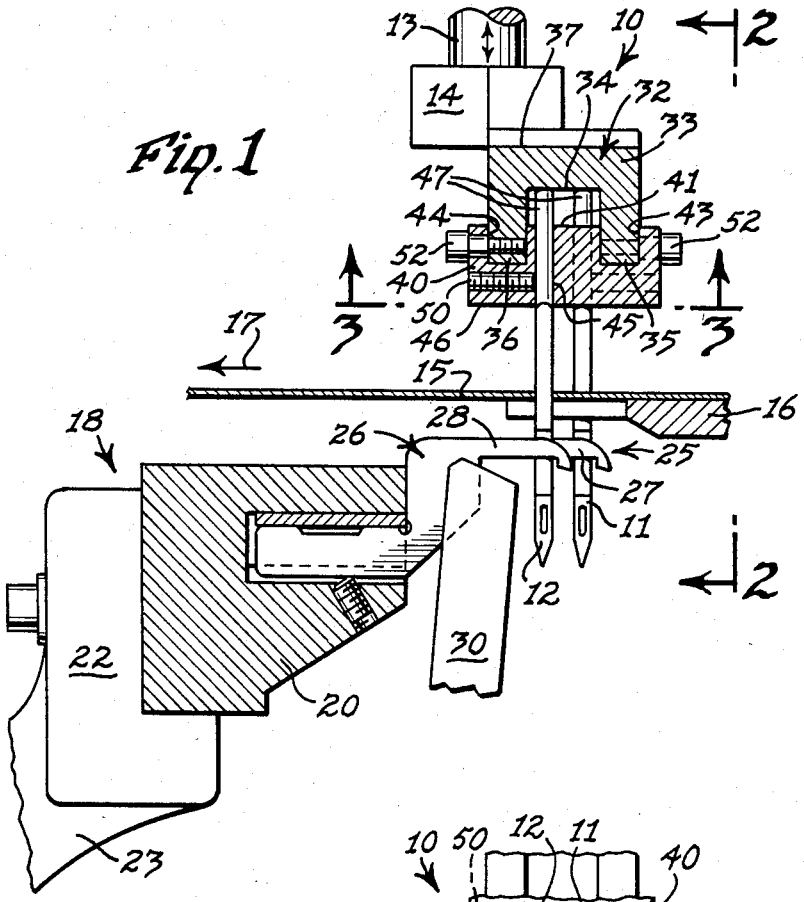
FIG. 1 is a fragmentary sectional elevation taken longitudinally along the line 1—1 of FIG. 3, through a portion of a narrow gauge, staggered-needle tufting machine, incorporating a cutpile looper apparatus, and incorporating the needle bar assembly made in accordance with this invention.

Referring now, to the drawings in more detail, FIG. 1 discloses a cross-section of a needle bar assembly 10 made in accordance with this invention assembled in a conventional multiple-needle tufting machine. The needle bar assembly 10 supports a first row of uniformly spaced front needles 11 and a second row of uniformly spaced rear needles 12 offset preferably mid-way between the front needles 11, to provide a uniform, narrow gauge, staggered needle tufting machine. The needle bar assembly 10 is vertically reciprocated by conventional needle drive means, including a push rod 13 connected to the needle bar assembly 10 by an attachment collar 14. The push rod 13 vertically reciprocates the needle bar assembly 10 to cause the front and rear needles 11 and 12 to move between an upper position above the base fabric 15 to a lower position (FIG. 1) penetrating the base fabric 15, so that the needles will carry yarns, not shown, through the base fabric 15 to form loops of tufting therein. The base fabric 15 is supported upon a needle plate 16 for movement, by means not shown, in the direction of the arrow 17 of FIG. 1, that is longitudinally from front-to-rear of the machine.

The looper apparatus 18 which cooperates with needles 11 and 12 may include a transverse hook bar 20 of unique, or conventional, construction fixed upon a bracket 22 carried by a rocker arm 23 journalled on a rock shaft, not shown. The rocker arms 23 are driven by conventional means, not shown, for limited reciprocal movement in synchronism with the reciprocal movement of the needles 11 and 12. The hook bar 20 supports a plurality of looper hooks 25 and 26 having bills 27 and 28 of different lengths to cooperate with the respective needles 11 and 12 to seize the corresponding loops of yarn formed by the respective needles 11 and 12 below the base fabric 15.

Where cut pile is formed by the needles 11 and 12 and the corresponding looper hooks 25 and 26, a knife 30 is reciprocably supported to cooperate with each hook for cutting the seized loops, in a well known manner.

Figure 2:
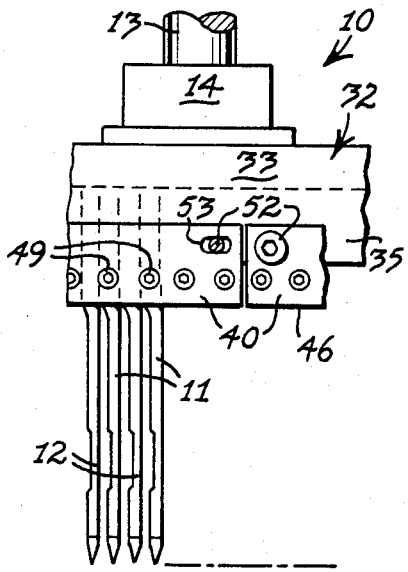
FIG. 2 is a fragmentary front elevation of the needle bar assembly, taken along the line 2—2 of FIG. 1.
Figure 3:
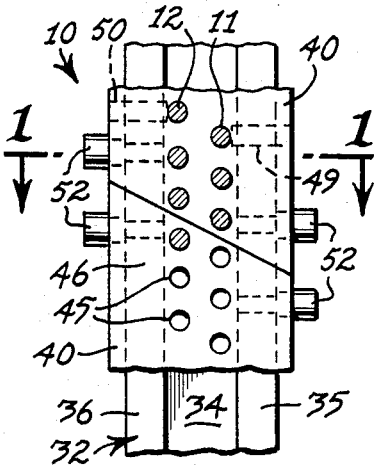
FIG. 3 is a fragmentary bottom plan view taken along the line 3—3, of FIG. 1, with portions broken away.

In the first embodiment of the invention disclosed in FIGS. 1–3, the needle bar assembly 10 includes a continuous elongated needle mounting bar 32 disclosed as having an inverted U-shaped cross-section. The mounting bar includes an upper main body portion 33 having a bottom needle abutment surface 34 and a pair of depending legs 35 and 36 spaced apart in a front-to-rear direction greater than the front-to-rear spacing of the front needles 11 and the rear needles 12. The top surface 37 of the main body portion 33 is connected to the attachment collar 14 of the push rod 13. The mounting bar 32 extends the entire width of the stitching area, or in other words, has at least as great a span as the width of the base fabric 15 moving through the tufting machine. The mounting bar 32 is substantially the same length as a conventional needle bar.

Detachably mounted upon the mounting bar 32 are a plurality of elongated needle bar segments 40 each of substantially shorter length than the overall length of the mounting bar 32. Each needle bar segment 40 may be approximately 6–12" long. The top surface 41 of each needle bar segment 40 is preferably spaced below the abutment surface 34 of the mounting bar 32, and is provided with a pair of grooves or recesses 43 and 44 parallel to each other and extending longitudinally of each corresponding needle bar segment 40. The recesses 43 and 44 have the same front-to-rear spacing and substantially the same front-to-rear dimensions, as the legs 35 and 36 in order to snugly receive the depending legs 35 and 36 within the corresponding recesses 43 and 44. Formed through the height or depth of each needle bar segment 40 are a plurality of elongated needle holes 45 opening through the top surface 41 and the bottom surface 46, parallel to each other, and arranged at the desired needle gauge and spacing, such as the staggered needle arrangement disclosed in FIGS. 1–3. Each needle hole 45 may be drilled in the same manner as conventional needle bars. However, because of the relatively shallow depth or height of the bar segments 40, substantially less drilling is required, and more accurate drilling is obtained.

Each of the needle holes 45 is of a configuration adapted to snugly receive the shank portion 47 of each of the needles 11 and 12. The shank portions 47 may project above the top surface 41 of each needle bar segment 40, as disclosed in FIG. 1, and engage the needle abutment surface 34 of a mounting bar 32. In this manner, the vertical positions of the needles 11 and 12 may be accurately located, and the shank portions 47 may be gripped by the needle holes 45 below the upper ends of the shank portions 47 over a shorter length, to stabilize the needles 11 and 12 as well as needles are stabilized in a conventional needle bar.

Each of the needles 11 and 12 are secured in their respective needle holes 45 by the front and rear set screws 49 and 50 in substantially the same manner as the needles would be secured in a conventional needle bar.

The legs 35 and 36 are secured in their overlapping, dove-tailed, or tongue-and-groove engagement with their corresponding recesses 43 and 44 by means of the transverse threaded fasteners, such as the bolt members 52.

As disclosed in FIG. 2, each bolt 52 may extend through an oversized, oval, or elongated bolt hole 53 in the side of the corresponding needle bar segment 40 before threadely engaging a corresponding threaded hole within the corresponding leg 35 of the mounting bar 32. The oversized hole 53 permits longitudinal or end-to-end adjustment between adjacent needle bar segments 40. The adjacent, opposing ends of the needle bar segments 40 disclosed in FIG. 2 are shown slightly separated, such as by a spacing in the order of 0.008–0.010 inches. Thus, lateral adjustment is permitted between adjacent needle bar segments 40 to correct for any slight errors in the needle gauge, or to permit localized alignment of the needles 11 and 12 with their corresponding hooks 25 and 26.

It will be apparent from the above description that a needle bar assembly 10 has been developed which substantially reduces the cost and time of manufacture, and also provides more accurate needle gauges, and optionally, a needle bar assembly in which the needle gauge may be subject to slight adjustments.

Moreover, the needle bar assembly 10 made in accordance with this invention, permits the use of a single, long mounting bar 32 which may be permanently connected to the push rods 13, and which supports a plurality of replacable and interchangeable needle bar segments, which can be utilized for readily replacing worn parts without discarding an entire single long needle bar. Furthermore, needle gauges of varying sizes may be utilized with the same mounting bar 32 by mere replacement of the entire set of needle bar segments 10 with another set of needle bar segments of different needle gauge.

Figure 4:
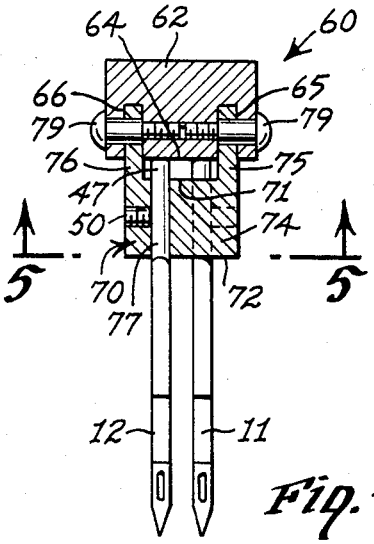
FIG. 4 is a sectional elevation taken along the line 4—4, of FIG. 5, of a modified needle bar assembly.
Figure 5:
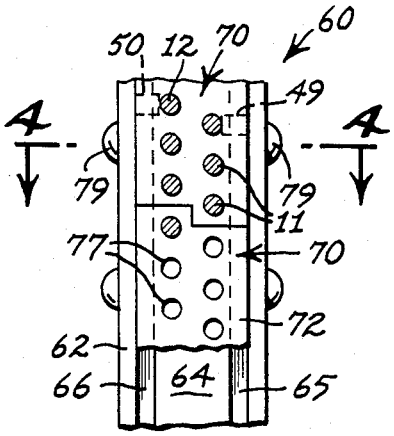
FIG. 5 is a fragmentary section taken along the line 5—5 of FIG. 4, with portions broken away.

In the second embodiment of the needle bar assembly 60 disclosed in FIGS. 4 and 5, the cross-sections of the mounting bar 32 and the needle bar segments 40 have been reversed. The structure of the elongated needle mounting bar 62 is of substantially rectangular cross-section and the needle bar segments 70 are each of U-shaped cross-section.

The mounting bars 62 of the needle bar assembly 60 includes a bottom needle abutment surface 64 in which are formed parallel or elongated grooves or recesses 65 and 66. The recesses 65 and 66 are of a spacing and shape to snugly receive the upward projecting legs 75 and 76 from the main body portion 74 of the needle bar segments 70. The top surface 71 of the main body portion 74 of the needle bar segment 70 is spaced below the needle abutment surface 64 to provide additional room for the upward projection of the shank portions 47 of the needles 11 and 12, which abut the bottom surface 64 of the mounting bar 62.

Needle holes 77 are formed in the main body portion 74 to extend entirely through the main body portion 74. The needle holes 77 open through the bottom surface 72 and the top surface 71 and are arranged in the same configuration and gauge as the needles 11 and 12.

The legs 75 and 76 are secured in the recesses 65 and 66 by the bolt members 79 in the same manner as the corresponding legs 35 and 36 are secured in the recesses 43 and 44 of the needle bar assembly 10 by bolt members 52.

The needles 11 and 12 are secured within the needle holes 77 by the set screws 49 and 50.

Otherwise, the structure and function of the needle bar assembly 60 is essentially the same as that of the needle bar assembly 10.

Because, as best disclosed in FIG. 4, each needle bar segment 70 of the needle bar assembly 60 has a lesser front-to-rear dimension than the corresponding dimension of the mounting bar 62, threads of yarn may be fed to the needles 11 and 12 from the yarn feed rolls, not shown, so that they will extend more nearly parallel to the needles 11 and 12 when they are threaded through the needle eyes.

FIGS. 6–9 disclose a modified form of a needle bar assembly 80 especially adapted to be used with dual shiftable needle bars, such as those disclosed in U.S. Pat. No. 4,366,761 of Roy T. Card, issued Jan. 4, 1983.

The needle bar assembly 80 supports a first row of uniformly spaced front needles 11 and a second row of uniformly spaced rear needles 12 offset preferably midway between the front needles 11, to provide a uniform, narrow gauge, staggered needle tufting machine. The needle bar assembly 80 is vertically reciprocated by conventional needle drive means, including the push rods 13 connected to the needle bar assembly 80 by attachment collars 14'. The push rods 13 vertically reciprocate the needle bar assembly 80 to cause the front and rear needles 11 and 12 to move in the same manner as the needles 11 and 12 are moved by the needle bar assembly 10 or 60 in FIGS. 1–5, to penetrate the base fabric 15 to form loops of tufting therein.

The looper apparatus 18 which cooperates with the needles 11 and 12 may be of the same construction as the looper apparatus 18, disclosed in FIG. 1, cooperating with the same knives 30.

The needle bar assembly 80 includes a continuous elongated needle bar holder or slide holder 81 fixedly connected to the push rod collars 14'. The needle bar slide holder 81 includes a pair of parallel slideways 82 and 83 for reciprocably and slideably receiving slides 84 and 85 of substantially T-shaped cross-section. Each slide 84 is fixed to a continuous elongated front needle bar or front needle mounting bar 86, while each slide 85 is fixed to a continuous elongated rear needle bar or needle mounting bar 87.

The needle bar holder 81 and the front and rear needle bars 86 and 87 extend the entire width of the stitching area, and are driven, and operate, in the same manner as the dual shiftable needle bar assembly disclosed in U.S. Pat. No. 4,366,761.

Formed in the inner opposed faces of the needle mounting bars 86 and 87 are a pair of elongated recesses 88 and 89. Each of these recesses 88 and 89 is adapted to receive in assembled end-to-end position, a corresponding set of needle bar inserts or segments 90 and 91. Each of the segments 90 and 91 is substantially shorter than the overall length of either of the needle bars 86 or 87.

Moreover, each of the needle bar segments 90 and 91 preferably has an L-shaped cross-section, as best disclosed in FIGS. 6 and 9, including an upper vertical leg portion 92 and a lower foot flange 93. The upper leg portion 92 of each segment 90 and 91 is adapted to be received substantially flush and in snug engagement within each corresponding recess 88 and 89. Each foot flange 93 is provided to limit the upward movement of each needle bar segment 90 and 91 within its corresponding recess 88 and 89 and to seat against the bottom surface of each of the corresponding needle bars 86 and 87.

A plurality of needle holes 95 are formed vertically through the bottom portion of each of the needle bar segments 90 and 91 and are arranged in transverse longitudinal alignment, yet offset from the needle holes in the opposite needle bar segment so that the needles 11 and 12 are arranged in a conventional staggered pattern for each stitch penetration of the base fabric 15.

Each of the needles 11 and 12 is retained in fixed position within a corresponding needle hole 95 by conventional set screws 96 and 97, respectively.

Each of the needle bar segments 90 and 91 is retained in its respective recess 88 and 89 by the threaded bolts 98, in a manner similar to the retention of the needle bar segments 40 and 70 in the respective needle bar assemblies 10 and 60.

Otherwise, the needle bar segments 90 and 91 in the needle bar assembly 80 have substantially the same function and advantages as the needle bar segments 40 and 70 in the corresponding needle bar assemblies 10 and 60.

The bolts 98 may also be provided with elongated, or over-sized, bolt holes, such as the elongated bolt holes 53 disclosed in FIG. 2, for transverse adjustments of the short needle bar segments 90 and 91.

What is claimed is:

1. In a multiple needle tufting machine having a plurality of uniform needles, each needle having a pointed end portion and a shank adjacent its opposite end portion, and a needle drive member, a needle bar assembly comprising:

(a) an elongated needle mounting bar member comprising a pair of needle bars of predetermined length connected to the needle drive member for reciprocable movement in a stitching direction, (b) a needle bar holder, (c) means slideably mounting said needle bars in said needle bar holder for independent slideable movement longitudinally of said needle bars, (d) a pair of sets of elongated needle bar segments, each set comprising a plurality of elongated needle bar segments, each segment being of a length substantially less than the length of said mounting bar member, (e) each needle bar segment having a plurality of elongated needle holes therethrough having parallel longitudinal axes, each needle hole being adapted to coaxially receive the shank of a needle, (f) needle securing means for holding a needle in a corresponding needle hole, (g) said mounting bar member and each of said needle bar segments comprising overlapping portions, (h) bolt means connecting the overlapping portions of one set of needle bar segments to one of said needle bars and connecting the overlapping portions of said other set of needle bar segments to the other of said needle bars, the needle bar segments in each set being arranged end-to-end along said mounting bar member so that the longitudinal axes of said needle holes are parallel to said stitching direction.

2. The invention according to claim 1 in which each of the needle bars comprise opposed recesses, and said first and second sets of needle bar segments comprise projecting portions received in said corresponding recesses, said bolt means connecting said projecting portions within said recesses to said needle bars.

3. The invention according to claim 2 in which said first and second sets of needle bar segments comprise lower flange portions below said recesses, said elongated needle holes extending through said flange portions, said needle securing means comprising set screws extending through said flange portions for securing said needles to said first and second sets of needle bar segments.

4. The invention according to claim 3 in which each of said needle bar segments has a substantially L-shaped cross-section.

5. The invention according to claim 2, in which said bolt means comprises first and second sets of bolts, each of said sets of bolts projecting laterally through corresponding portions of said first and second needle bars, said first and second sets of needle bar segments having transverse threaded bolt holes extending through said corresponding projecting portions above said needle holes for receiving said corresponding bolts.

* * * * *